US005468970A

United States Patent [19]

Kocsis et al.

[11] Patent Number: 5,468,970

[45] Date of Patent: Nov. 21, 1995

[54] DEVICE FOR COLLIMATING BEAMS OF A RADIATION

[75] Inventors: Menhard Kocsis, Meylan; Bela Farago, Notre Dame de Mesage, both of France

[73] Assignee: Institut Max Von Laue - Paul Langevin, Grenoble Cedex, France

[21] Appl. No.: 166,746

[22] Filed: Dec. 14, 1993

[30] Foreign Application Priority Data

Dec. 14, 1992 [FR] France ..... 92 15028

[51] Int. Cl.[6] ..... G21K 1/02

[52] U.S. Cl. ..... 250/505.1; 378/149

[58] Field of Search ..... 250/505.1; 378/149, 378/147, 154

[56] References Cited

U.S. PATENT DOCUMENTS 4,118,632 10/1978 Luig ..... 250/505.1

4,754,147 6/1988 Maughan et al. ..... 250/505.1

FOREIGN PATENT DOCUMENTS 2547981 4/1977 Germany .

OTHER PUBLICATIONS

Space Science Reviews, No. 8, 1968, Dordrecht–Holland, pp. 471–506, Bradt et al. "The modulation collimator in X–ray astronomy".

Physics in Medecine and Biology, vol. 24, No. 2, 1979, London GB, pp. 438–439 Clarke et al., "Wire–wound multi–aperture collimator".

United States Statutory Invention Registration No. H897, Wiencek et al., Mar. 1991 French Search Report–FR 9215028–FA 480929–Aug. 1993.

*Primary Examiner*—Jack I. Berman

*Attorney, Agent, or Firm*—Pearne, Gordon, McCoy & Granger

[57] ABSTRACT

Device for collimating beams of a radiation. This device includes a plurality of parallel plys (8) of wires (10) which are made of or coated with a material able to absorb the radiation. Application to the collimation of beams of neutrons.

8 Claims, 2 Drawing Sheets

DEVICE FOR COLLIMATING BEAMS OF A RADIATION

FIELD OF THE INVENTION

The present invention concerns a device for collimating beams of a radiation.

BACKGROUND OF THE INVENTION

It is applicable more particularly for collimating beams of neutrons and beams of X rays.

Frequently, it may be desired to limit the angular distribution of a radiation beam without actually losing its luminosity.

In order to achieve this, a Soller collimator is used.

An example of this type of collimator is diagrammatically shown on FIG. 1.

It includes a plurality of fine parallel thin strips 2 which are able to absorb the incident radiation 4 it is desired to collimate, or strips which are coated with a material able to absorb this radiation.

The ratio Do/Lo of the distance between the strips 2 to the length Lo of these strips is equal to the tangent of half the desired maximum divergence $2\phi$ for the radiation beam 6 coming out of the collimator.

So as to avoid wasteful losses, the finest thin strips are used.

A Soller collimator does, however, have drawbacks.

In fact, if the radiation to be collimated arrives below a certain critical angle of incidence on the thin strips, it is reflected (total reflection effect), despite the presence of the absorbing material.

Accordingly, it is not possible to collimate the incident radiation beam below the critical angle.

In addition, this total reflection risks contaminating (this not being desired) the radiation beam diffused by a sample (not shown on FIG. 1) which is illuminated by the collimated beam.

SUMMARY OF THE INVENTION

The object of the present invention is to resolve these drawbacks.

In order to achieve this, the device of the present invention for collimating beams of a radiation is characterized in that it includes a plurality of parallel plys of wires which are made of or coated with a material able to absorb the radiation.

The use of such wires makes it possible to significantly reduce the surface which partly causes the total reflection of the radiation.

According to a preferred embodiment of the device of the invention, the wires used are round.

In this case, the surface partly causing total reflection is almost nil.

Preferably, in each ply, each wire of row n for any whole number greater than or equal to 3 is tangent to the plane which passes between the wire of row n-1 of this ply and the wire of row 1 of an adjacent ply and which is tangent to this wire of row 1 and the wire of row n-1.

This makes it possible to have wires placed at maximum distances from one another and thus use a minimum number of wires, this allowing for a further reduction of the surface partly causing total reflection.

According to a particular embodiment of the device of the invention, said material is able to absorb neutrons, the device thus being able to collimate beams of neutrons. In that case, as an absorbant material, it is possible to use cadmium or gadolinium but boron is preferably used.

With boron wires and a neutronic radiation, the irradiation dose due to the absorbtion of the neutrons is reduced by a factor 10 with respect to an absorbant material made of cadmium or gadolinium.

BRIEF DESCRIPTION OF THE DRAWINGS

The present invention shall be more readily understood from a reading of the description of embodiment examples, given purely by way of illustration and being non-restrictive, with reference to the accompanying drawings on which.

DETAILED DESCRIPTION OF THE PREFERRED EMBODIMENTS

Figure 1:
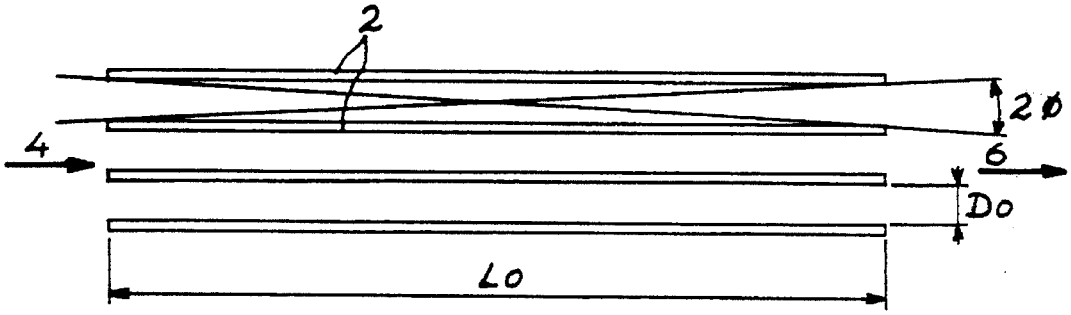
FIG. 1 (PRIOR ART)
FIG. 1 is a diagrammatic cutaway view of a known type of collimation device already described.
Figure 2:
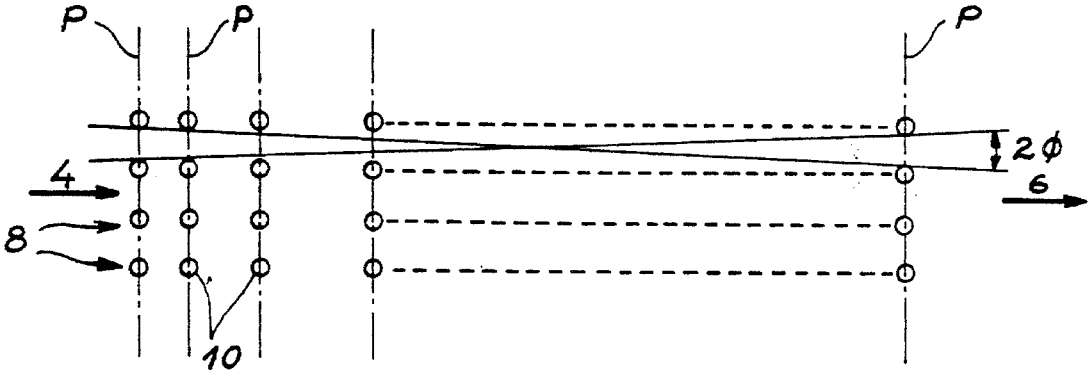
FIG. 2 is a diagrammatic cutaway view of a particular embodiment of the collimation device of the present invention.

FIG. 2 diagrammatically shows a section of a collimation device conforming to the invention and able to collimate an incident beam of radiation 4 and obtain at the outlet of this collimation device a collimated beam 6, the maximum divergence of this outgoing beam 6 being equal to $2\phi$.

The collimation device or collimator shown in FIG. 2 includes a plurality of parallel plys 8 of wires 10 which are made of or coated with a material able to absorb the radiation.

In the example shown in FIG. 2, the plys 8 are equidistant from one another and in each ply 8 the wires 10 are round wires parallel to one another and the wires of a given row, that is with the same order number in the plys, are in planes P parallel to one another and perpendicular to the planes of the plys 8.

Figure 3:
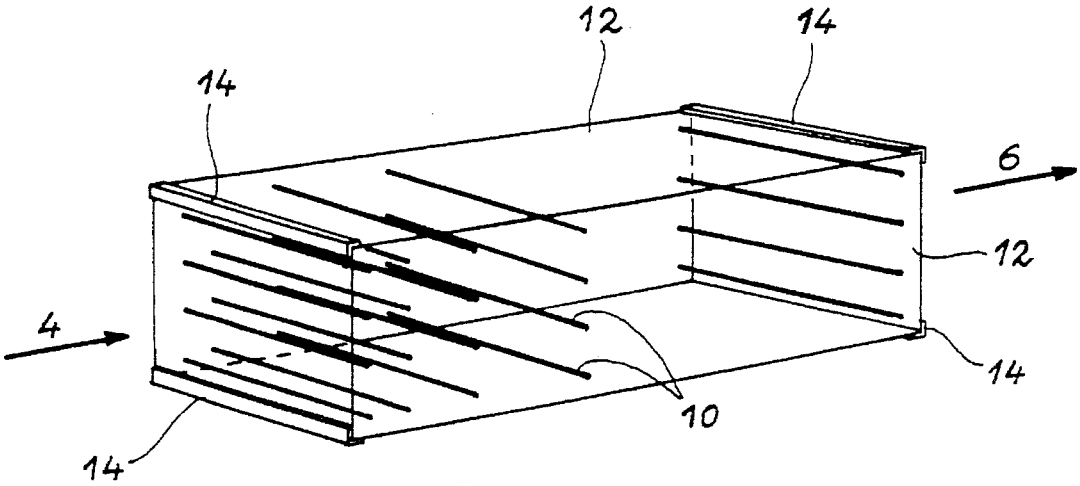
FIG. 3 is a diagrammatic perspective view of a collimation device conforming to the invention, and FIG. 4 diagrammatically illustrates a geometrical construction able to reduce to a minimum the number of wires of a collimation device conforming to the invention.

FIG. 3 shows a perspective view of a collimator conforming to the invention.

As can be seen in FIG. 3, the wires 10 are individually stretched between two parallel plates 12 which are rendered strictly integral with each another, for example by means of braces 14 (placed outside the beam to be collimated 4).

In order to collimate a beam of neutrons, boron wires which are able to be stretched between the plates 12 are preferably used.

As a variant, it is possible to use tungsten wires coated with boron.

In the case where one wishes to collimate a beam of X rays, use is made of wires which are made of or coated with a material able to absorb the X rays, preferably tungsten wires.

Figure 4:
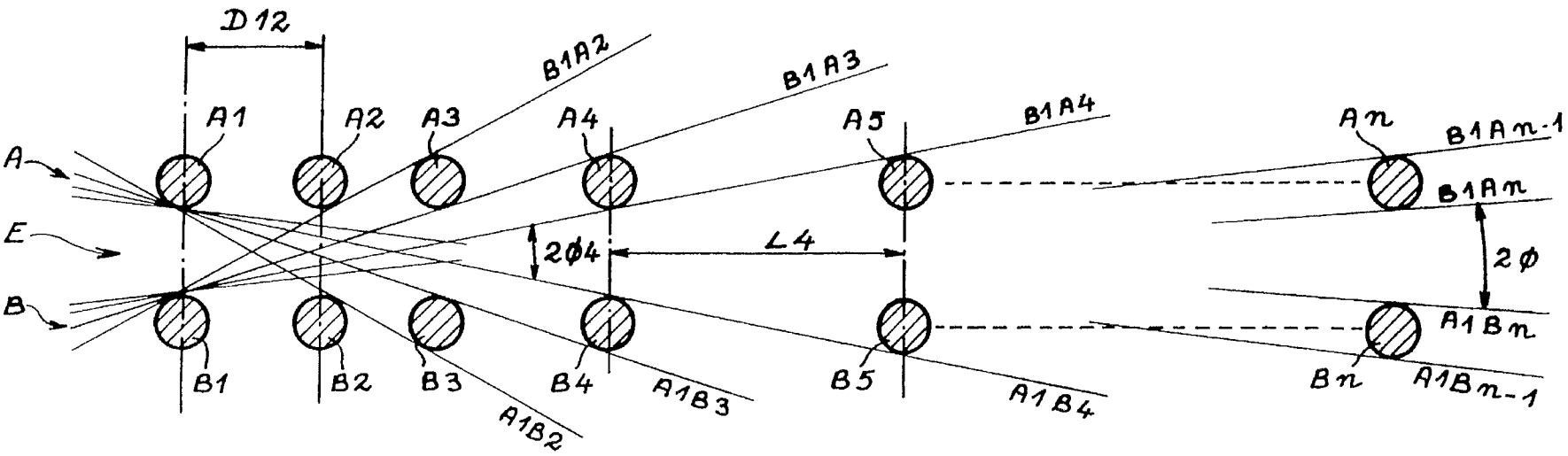

FIG. 4 diagrammatically shows the way on how the wires are placed in relation to one another in a collimator conforming to the invention so as to use a minimum number of wires.

The collimator diagrammatically and partly shown in FIG. 4 includes a plurality of parallel plys of round wires, such as the adjacent plys A and B.

Having selected the maximum divergence 2ϕ it is desired to obtain with the collimator of FIG. 4, the distance D12 is selected between the first two wires A1 and A2 of the ply A (which is equal to the distance between the first two wires B1 and B2 of ply B).

Then the position of the third wire A3 of the ply A is determined and the position of the third wire B3 of the ply B is determined as indicated hereafter.

The wire A3 is tangent to the plane B1 A2 which passes between the wires B1 and A2 and which is tangent to these wires B1 and A2.

Similarly, the wire B3 is tangent to the plane A1 B2 which passes between the wires A1 and B2 and which is tangent to these wires A1 and B2.

Then the position of the wires A4 and B4 is determined as follows.

The wire A4 is tangent to the plane B1 A3 which passes between the wires B1 and A3 and which is tangent to these wires B1 and A3.

Similarly, the wire B4 is tangent to the plane A1 B3 which passes between the wires A1 and B3 and which is tangent to these wires A1 and B3.

Thus, FIG. 4 shows how the collimator is gradually formed.

The construction of this collimator is completed with the wires of row n, such as the wires An and Bn, making it possible to obtain the initially fixed maximum angle of divergence 2ϕ.

The distance Li between the wires Ai and Ai+1 (equal to the distance between the wires Bi and Bi+1) depends on the distance d of the wires and the local angular divergence 2×ϕi of the beam of radiation at the level of the wires of row i (FIG. 4 shows the parameters L4 and 2×ϕ4 which relate to the wires of row i=4).

The distance Li (maximum distance between the wires Ai and Ai+1) is such that:

$$Li=d/tg\phi i.$$

As ϕi reduces when i increases, that is gradually when the radiation extends into the collimator (in other words when going away from the inlet E of this collimator), the spacing Li of the wires is an increasing function of i.

The construction explained above thus makes it possible to embody a collimator conforming to the invention with a minimum number of wires.

By way of non-restrictive illustration, in order to embody a collimator conforming to the invention for collimating a beam of neutrons and obtain at the outlet of this collimator a maximum angular divergence beam equal to 0.5°, the following parameters are used:

boron wire, diameter 0.1 mm length of collimator: 250 mm distance between two adjacent plys: 2.2 mm.

The present invention is able to significantly reduce and, in certain preferred embodiments, completely eliminate the total reflection of the radiation.

Furthermore, the fact of stretching the wires individually makes it possible to clearly define the ply constituted by these wires, contrary to the case with stretched strips which are used in known types of Soller collimators, these strips from a mechanical point of view having a poorly determined position, especially at the inlet and outlet of this Soller collimator (it never being possible to ensure that a strip is not warped).

In addition, the wires are less sensitive than these strips to thermic variations and degradation by the radiation.

What is claimed is:

1. Device for collimating divergent beams of a radiation, said device comprising a plurality of parallel plys of wires which are made of or coated with a material able to absorb the radiation so as to collimate a beam of the radiation which propagates along a direction which is substantially parallel to the plys.

2. Device according to claim 1, wherein the wires are round.

3. Device according to claim 1, wherein in each ply, each wire of row n for any whole number n greater than or equal to 3 is tangent to a plane which passes between the wire of row n-1 of this ply and the wire of row 1 of an adjacent ply and which is tangent to this wire of row 1 and this wire of row n-1, the wires of row 1 corresponding to an inlet of the device.

4. Device according to claim 1, wherein said material is able to absorb neutrons, the device thus being able to collimate beams of neutrons.

5. Device according to claim 4, wherein said material is boron.

6. Device according to claim 1, wherein in each ply, spacing of the wires increases from the inlet to the outlet of the collimator.

7. Device according to claim 1, wherein the wires are individually stretched between two parallel plates.

8. Process for collimating a divergent beam of a radiation, said process including the steps of providing a device comprising a plurality of parallel plys of wires which are made of or coated with a material able to absorb the radiation, and sending said beam toward said device along a direction which is substantially parallel to the plys.

* * * * *